US005655579A

United States Patent [19]

Prescott et al.

[11] Patent Number: 5,655,579

[45] Date of Patent: Aug. 12, 1997

[54] METHOD AND PPARATUS FOR TESTING FIRE SUPPRESSION SYSTEMS

[75] Inventors: Robert C. Prescott, N. Marshfield; Joseph A. Senecal, Wellesley, both of Mass.

[73] Assignee: Kidde-Fenwal, Inc., Ashland, Mass.

[21] Appl. No.: 437,182

[22] Filed: May 8, 1995

[51] Int. Cl.[6] ..... B65B 1/04

[52] U.S. Cl. ..... 141/83; 141/94; 141/114; 73/865.8

[58] Field of Search ..... 141/83, 94, 95, 141/114, 10, 1; 73/865.8, 198; 222/77; 169/30, 71, 43, 91

[56] References Cited

U.S. PATENT DOCUMENTS

| | | | |
|---|---|---|---|
| 3,875,980 | 4/1975 | Getz | 141/83 |
| 4,768,347 | 9/1988 | Manz et al. | 141/83 |
| 4,991,633 | 2/1991 | Wong | 141/83 |
| 5,176,187 | 1/1993 | Grant | 141/10 |

OTHER PUBLICATIONS

Module 1093 HVACR Classroom Series, An Educational Service of VGI Training, A Division of Video General Inc. pp. 24–39 (no available date).

*Primary Examiner*—Henry J. Recla
*Assistant Examiner*—Steven O. Douglas
*Attorney, Agent, or Firm*—Darby & Darby

[57] ABSTRACT

A method and apparatus for testing a fire suppressing system having outlet nozzles from which a high pressure suppressant agent is discharged in which a vessel is attached to each nozzle to capture the agent discharged during a test. The collection vessel is preferably an elongated plastic bag that is rolled to remove air from the bag before agent is discharged into it. The amount of agent captured in a vessel is calculated, such as by weighing. The captured discharged agent is compressed for return to a storage container in which it can be re-pressurized for further use.

8 Claims, 2 Drawing Sheets

METHOD AND PPARATUS FOR TESTING FIRE SUPPRESSION SYSTEMS

FIELD OF THE INVENTION

The invention relates to a method and apparatus for testing of fire suppression systems using pressurized liquified gases as the suppression agent without releasing the gas to the atmosphere and the recovery of such gas after testing.

BACKGROUND OF THE INVENTION

Fire suppression systems for enclosed spaces, such as computer installations and other similar areas, operating with liquified gases under high pressure which expand when released as the suppression agent are well known. The gas is typically distributed into the spaces of a protected hazard zone by a system of pressurized storage cylinders operating through distribution piping using nozzles for outlets. For example, fire suppression systems using Halon 1301 as the suppression agent have been in widespread use for many years offering reliable, convenient protection with many advantages.

A typical way to test the operability of such systems and its components is to release an amount of the suppressant into the protected area during a test discharge simulating normal use. Concentration measurements are then taken in each protected space to determine the specified weight of the agent that had been discharged through the piping system to make sure that the discharge of the agent is correctly proportioned among the protected spaces.

While such a test usually achieves its desired goal, it has disadvantages in that the fire suppressant is released into the atmosphere. Some types of fire suppressant agents, including Halon 1301, have been considered by some to contribute to atmospheric ozone depletion and have been banned. New fire suppressant agents are currently under test for use and are actually being used. One such agent is FM-200 (heptaflouropropane), which is described in U.S. Pat. No. 5,124,053, manufactured by Great Lakes Chemical Corporation of West Lafayette, Ind., which is said to be a more environmentally friendly agent.

With the use of any gaseous fire suppressant agent, whether it be FM-200, Halon 1301, or other agent, testing is desired to be carried out to determine the operability and capabilities of an installed system. The cost of conducting discharge tests has escalated due both to high cost of the agents and the relatively higher quantity of agents used. Further, the acceptability of discharging any chemical agents into the atmosphere has decreased due to environmental considerations unrelated to stratospheric ozone depletion. Accordingly, a need exists to be able to test the system without the release of the agent into the atmosphere and also to be able to recover the released agent for re-use so that it will not be wasted.

BRIEF DESCRIPTION OF THE INVENTION

The present invention relates to a method and apparatus for testing fire suppressant systems. In accordance with the invention, a vessel, preferably a bag that can be stored in a manner so that it is basically free of contained air, is connected to each of the nozzles of the distribution system. Upon release of the pressurized agent from the system during the test, the agent is released into and captured by each bag. The bags are weighed to determine the amount of agent discharged from each nozzle. This determines the operability of the system and the amount of agent or nozzle discharge into a particular protected area.

During the test of the suppressant system, little or none of the fire suppressant agent is released to the atmosphere or otherwise lost. A compressor is used to recycle the fire suppressant agent captured in the bags back into a liquified gas storage container. A small quantity of the gas is lost during the recycle phase.

OBJECTS OF THE INVENTION

It is therefore an object of the invention to provide a method and apparatus for discharge testing of a fire suppressant system with minimal release of the suppressant agent to the atmosphere or other loss.

A further object is to provide a method and apparatus for testing a fire suppressant system in which the suppressant agent released during testing is captured in one or more bags, each attached to a discharge nozzle of the system for measurement of the amount of agent released.

An additional object is to provide a method and apparatus for testing a fire suppressant system in which the agent released during testing is captured for re-use.

BRIEF DESCRIPTION OF THE DRAWINGS

Other objects and advantages of the present invention will become more apparent upon reference to the following specification and annexed drawings, in which.

DETAILED DESCRIPTION OF THE INVENTION

Figure 1:
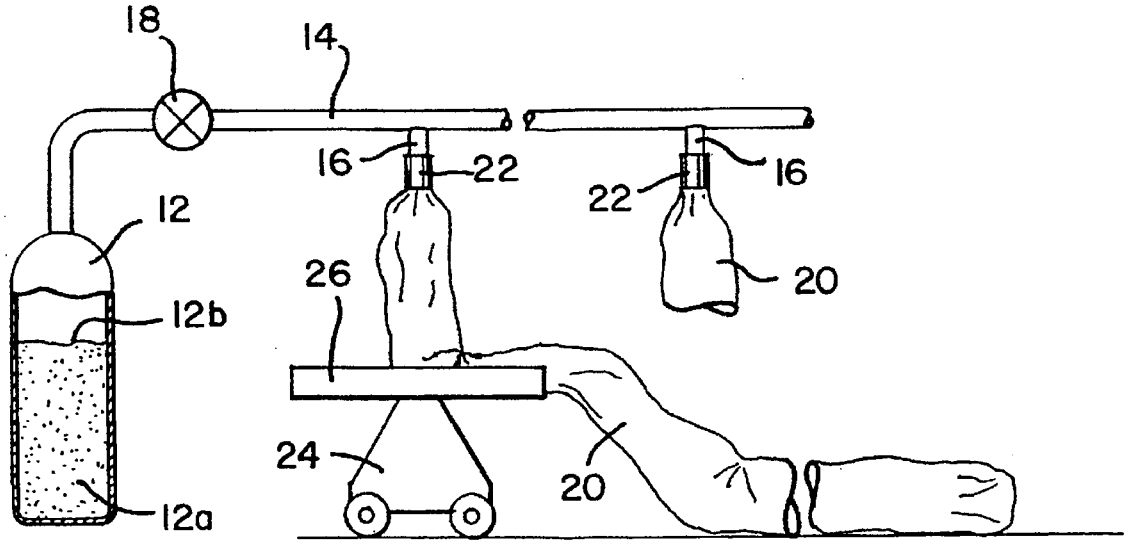
FIG. 1 is a schematic representation of the system.

FIG. 1 is an overall schematic view of a fire suppression system including a container 12 of pressurized fire suppressant agent **12*b*, such as FM-200 or HALON 1301, or other similar fire suppressant agent to a level 12*a*. The agent is highly pressurized by an inert propellent gas such as nitrogen. More than one container 12 can be used connected serially or a number of the containers can be used in a parallel bank. The pressurized agent upon release through a valve 18 is supplied to a conduit 14 which is routed through the area or areas to be protected. Control valve 18 is usually operated by using a suitable device, such as a temperature or smoke sensor. It can also be manually operated for normal use or for test purposes. The supply conduit 14 has one or more discharge nozzles 16 placed at preselected strategic locations in the protected area or areas. The suppressant agent is released from the container 12 and discharged through the nozzles 16**. Upon discharge into the air, the agent vaporizes and mixes with the air forming a fire suppressant mixture which covers and suppresses the fire. All of this is conventional.

For various reasons it is desired to periodically test all or a part of the system. In accordance with the invention, this is accomplished with the release of little or none of the pressurized suppressant agent into the atmosphere. To effect this, a collection vessel, preferably an elongated bag 20 is attached to each nozzle 16 from which agent is being released during the test to capture the released agent. Bag 20 is preferably of a flexible material, such as polyethylene.

The bag 20 has an inlet collar 22 which securely fits around a respective nozzle 16. The collar 22 can be of a threaded type to fasten to a nozzle or it can be of an open end type that fits around the nozzle and is secured by suitable ties, clamps or bands. The interior of the bag 20 preferably has an internal shroud (not shown) against which the agent released from a nozzle impacts. This prevents the released agent stream from directly striking the bag and possibly damaging it. Prior to its being attached to a nozzle, the bag 20 is preferably rolled and as much of the contained air as possible is forced out through the inlet 22.

To accomplish the test, the valve 18 is opened and the pressurized agent released from container 12. It travels through piping 1 4 and exits through a nozzle 16 into the bag 20 attached to the nozzle. The agent from each nozzle 16 entering the connected bag 20 is captured and is not released to the atmosphere. The test can be, for example, a full discharge or partial timed release of the pressurized agent in container 12. A scale 24, having a platform 26 is provided. Each bag 20 is weighed after detaching it from its nozzle upon completion of the test release of the agent.

To demonstrate the invention, each nozzle 16 of a system was provided with a bag of 0.004" thick polyethylene plastic, which when flat is about 48" wide. For FM-200, the dimension of the bag should have about ½ foot of length for each pound of the agent to be captured. The bags were carefully identified and weighed prior to the test. One end of each bag was secured to the nozzle with wire ties and the bag was closed at the opposite end. Installation was effected to minimize entrapment of air in the bag. That is, each bag is rolled up to discharge its contained air through its collar before being attached to a nozzle and the bag is then unrolled flat and can lay on the floor.

The maximum possible weight of agent in each bag (whose volume is known) is calculated using the factor of the specific volume of FM-200 vapor, also known, and at 70° F. is 2.2025 cubic feet per pound. During discharge from a nozzle the agent enters the bag which is unrolled and laid out flat, such as on a floor of the location. No air is entrained by the stream of agent being discharged from the nozzle. Therefore, the bag will contain, after agent discharge, all of the agent and the nitrogen with which it was super-pressurized plus only the air which was in the system tubing 14 through which the agent flowed.

After the test discharge is complete the agent (FM-200) in each bag is composed of gas and boiling liquid. Because the FM-200 is not permitted to mix with air it is denied the heat supplied by the air. After a short wait to allow vaporization of the liquid by heat conveyed from the floor, the bags of gas are weighed on a scale. In one application the scale was a 2.5'×20' frame of aluminum pipe suspended from a load cell. The bags are weighed in segments by sealing or pinching off a bag into lengths of about 20', much like sausages, which are then separated and the individual segments weighed on the scale.

Records were kept of the weights of bag segments. The data was entered into a computer program, such as a spreadsheet, where a factor is used to compensate the recorded weight for the buoyancy of air. This is done for the bag segments for each nozzle so that the flow characteristics of each nozzle can be determined individually. Direct weight measurements have agreed with the agent originally in the system's supply cylinder 12 with 98% to 100% accuracy in various tests conducted.

Figure 2:
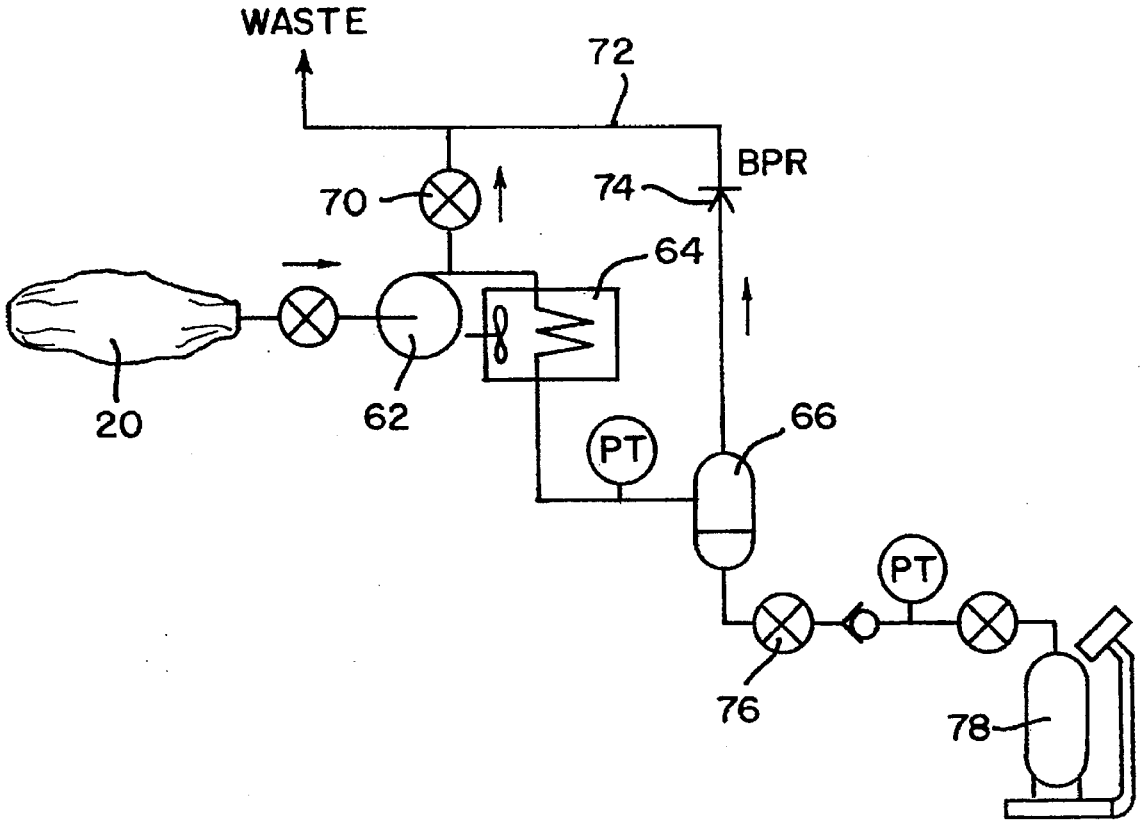
FIG. 2 is a schematic design of the recycling system.

When weighing is complete, the bag segments are successively connected to the inlet of a recovery system. As shown in FIG. 2, the recovery system includes a gas compressor 62, such as Model HD 362A by Blackmer of Grand Rapids, Mich., a condenser 64 and a gas liquid separator 66 such as a Model 21, made by Armstrong Machine Works of Three Rivers, Mich., with a level control valve 68. The gas compressor 62 should be the oil-less type. A 5 hp. compressor can compress about 2 pounds of FM-200 per minute. A larger size compressor can be used. The condenser 64 removes heat and cools the gas from the compressor to nearly ambient temperature, causing most of the FM-200 to condense. A safety relief valve 70 is provided to protect the condenser 64.

Nitrogen and FM-200 gas are drawn off at the separator 66 into a waste line 72 through a back pressure regulator 74. Liquid FM-200 is drawn off at the separator 66 to a storage container 78 through a level control valve 76. Suitable pressure and flow controls are provided in the recovery system where needed. The storage container 78 of the suppressant agent can be re-pressurized to make the agent usable again.

Because of the presence of the nitrogen used for super-pressurization not all of the FM-200 condenses. As nitrogen gas is removed at the liquid gas separator 66, it carries FM-200 vapor with it. The amount of loss of FM-200 is proportional to the total amount of air entrained during discharge of the agent into a bag and of nitrogen used to super-pressurize the FM-200. The nitrogen added to pressurize cylinders of FM-200 has been determined for a range of storage cylinder fill densities. It is a maximum at cylinder low fill density.

The amount of loss of the suppressant agent also depends on the temperature and pressure at the separator 66. The losses can be computed by applying Dalton's Law and the ideal gas law to the waste gas stream, assuming perfect gases:

$P_{Total}=P_{FM\text{-}200Vap}+P_{NZ}$, where $P_{FM\text{-}200Vap}$ is the vapor pressure of FM-200 and $P_{NZ}$ is the partial pressure of Nitrogen.

Since $N_{FM\text{-}200}=P_{m\text{-}200Vap}*V/kT$, and $N_{NZ}=P_{NZ}*V/kT$, where $N_{FM\text{-}200}$ is the number of moles of FM-200 mixed with, $N_{NZ}$, the number of moles of nitrogen, the $$N_{FM\text{-}200}=N_{NZ}*\frac{P_{FM\text{-}200Vap}}{(P_{total}-P_{FM\text{-}200Vap})}$$

Vapor pressure of FM-200 is given by Robin, in Pascals for temperature in Kelvin as:

$$P_{FM\text{-}200Vap}=^{(124.78-5672.2/T016,24\&IraT)}$$

Figure 3:
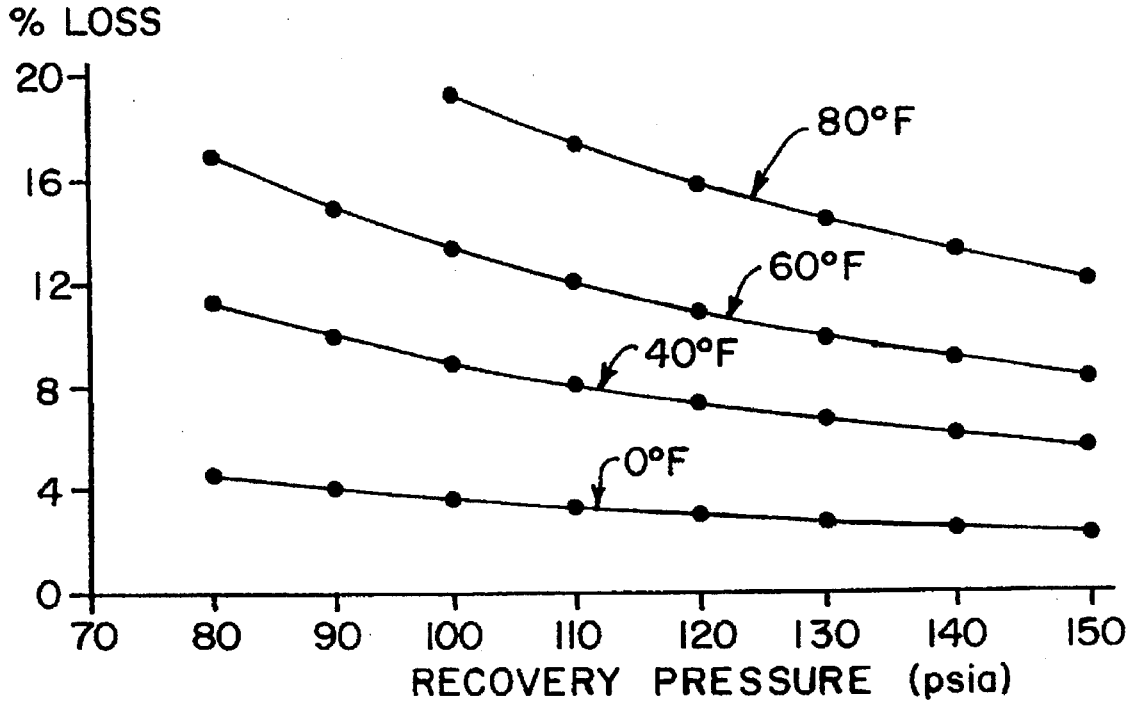
FIG. 3 is a graph showing loss of the suppression agent as a function of recovering pressure.

$N_{NZ}$, the total amount of nitrogen present from super-pressurization, was determined experimentally. The results of the computation in customary units are shown in FIG. 3. It can be seen that at moderate pressure (about 130 psia) good recovery is possible at 80° F. Operating at 80° F. permits use of ambient air for cooling the condenser, while the pressure is adequate for in-line transfer to an un-chilled storage cylinder without a pump.

The agent returned to the storage container 78 can be weighed. Using this method, it is feasible to recover about 87% at the worst case fill density of 30 lb./cubic foot. Recovery rates are much higher at high fill density when nitrogen content in the system storage container is reduced.

Figure 4:
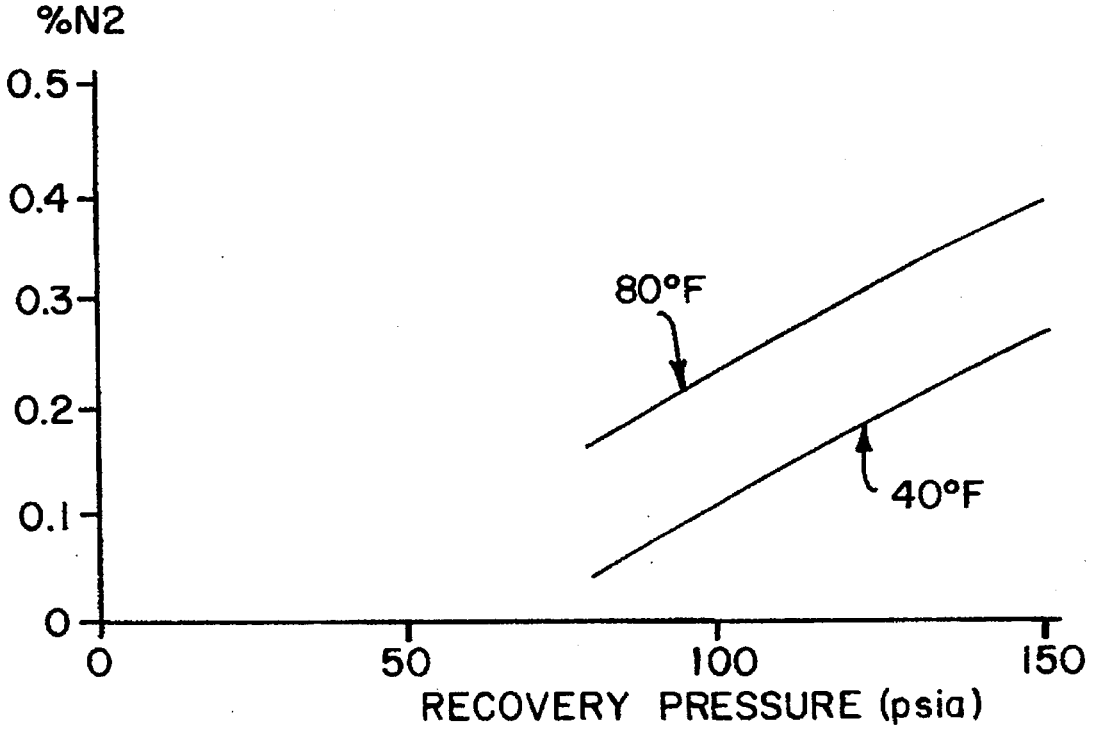
FIG. 4 is a graph showing the pressurizing gas in the reclaimed agent as a function of pressure at several different pressure.

There is a trade-off between recovery efficiency and excessive nitrogen and other gases dissolved in the recovered agent. At higher pressure and lower temperature more FM-200 is recovered, but the amount of gas dissolved in the agent increases. This is shown in FIG. 4.

Excessive nitrogen in the recovered agent causes difficulties with handling and storage. A second stage recovery operating at lower temperature and pressure provided improvements in recovery, but introduced equipment complexity.

After recovery, the agent is contaminated with dissolved water, nitrogen, and oxygen present in the humid air found in the suppressant system piping, and other volumes. However, non-volatiles, particulates and oils from the suppressant system piping tend to remain in the bags 20 which may be discarded after use.

Contaminated suppressant agent generally is not suitable for sale for most fire protection systems. If desired, the water can be removed by a molecular sieve and the agent re-used for flow testing only. Further processing of the recovered agent can make it suitable for re-use in a suppressant system.

While the invention has been described with respect to determining flow parameters of FM-200, the invention offers a workable economical non-polluting opportunity for on-site testing of total flooding systems. FM-200 thermodynamic properties are favorable for such tests, but the method also is useful with other suppression agents. Improved second stage recovery is useful to further reduce the amount of emissions and to further reduce cost.

What is claimed is:

1. A method for testing a fire suppressing system having a predetermined amount of pressurized fire extinguishing agent and at least one outlet through which the agent is discharged, comprising the steps of:

attaching a vessel to each of said at least one outlet of said system;

actuating said system thereby discharging an amount of the pressurized agent into said vessel;

capturing the discharged agent in the vessel; and comparing the amount of said captured discharged agent in said vessel with said predetermined amount of pressurized fire extinguishing agent.

2. A method as in claim 1 and further comprising the step of weighing the amount of agent captured into said vessel.

3. A method as in claim 1 further comprising the step of compressing the agent captured in said vessel and storing it in a container.

4. A method as in claim 3 wherein the storing step is carried out in an ambient temperature environment.

5. A method as in claim 3 wherein the storing step is carried out at a temperature below ambient.

6. A method as in claim 1 wherein the vessel is a flexible bag.

7. A method as in claim 1 further comprising the step of removing air from the vessel before discharge of agent into it.

8. A method as in claim 7 wherein the vessel is a flexible bag and further comprising the step of rolling the bag to expel air from its interior before attaching it to an outlet.

* * * * *

UNITED STATES PATENT AND TRADEMARK OFFICE

CERTIFICATE OF CORRECTION

PATENT NO. : 5,655,579

DATED : August 12, 1997

INVENTOR(S) : Robert C. PRESCOTT et al.

It is certified that error appears in the above-identified patent and that said Letters Patent is hereby corrected as shown below:

On the title page, item [54], Title, change "PPARATUS" to --APPARATUS--.

Col. 1, line 1, change "PPARATUS" to --APPARATUS--.

Signed and Sealed this

Sixteenth Day of December, 1997

Bruce Lehman

*Attest:*

BRUCE LEHMAN

*Attesting Officer*

*Commissioner of Patents and Trademarks*